US010557296B2

(12) United States Patent
Rejc

(10) Patent No.: US 10,557,296 B2
(45) **Date of Patent: *Feb. 11, 2020**

(54) WEIGHT COMPENSATION DEVICE OF A LIFTING DOOR WITH AT LEAST ONE COMPRESSION SPRING

(71) Applicant: Gabrijel Rejc, Landshut (DE)

(72) Inventor: Gabrijel Rejc, Landshut (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/997,959

(22) Filed: Jun. 5, 2018

(65) Prior Publication Data

US 2018/0283069 A1 Oct. 4, 2018

Related U.S. Application Data

(62) Division of application No. 14/361,394, filed as application No. PCT/EP2012/004697 on Nov. 12, 2012, now Pat. No. 10,012,015.

(30) Foreign Application Priority Data

Nov. 29, 2011 (DE) ..... 10 2011 119 895

(51) Int. Cl.
*E05D 13/00* (2006.01)
*E06B 9/62* (2006.01)
*E06B 3/44* (2006.01)

(52) U.S. Cl.
CPC ..... *E05D 13/1238* (2013.01); *E05D 13/123* (2013.01); *E05D 13/1215* (2013.01); *E05D 13/1246* (2013.01); *E06B 3/44* (2013.01); *E06B 9/62* (2013.01); *E05Y 2400/818* (2013.01); *E05Y 2900/00* (2013.01); *E05Y 2900/106* (2013.01)

(58) Field of Classification Search
CPC ..... E05D 13/1215; E05D 13/1238; E05D 13/1246; E05D 13/123; E06B 9/62
See application file for complete search history.

(56) References Cited

U.S. PATENT DOCUMENTS 1,416,071 A * 5/1922 Smurr ..... E05D 13/1238 160/189
1,942,320 A * 1/1934 Young ..... E05D 13/123 16/198

(Continued)

FOREIGN PATENT DOCUMENTS

EP 3002406 A1 * 4/2016 ..... E06B 9/60
FR 1109354 * 10/1954

(Continued)

*Primary Examiner* — Marcus Menezes
(74) *Attorney, Agent, or Firm* — Lorraine Hernandez; Kegler Brown Hill + Ritter Co LPA

(57) ABSTRACT

The invention relates to a weight compensation device for a drive of a lifting door, for the position-dependent compensation of the weight force of a door leaf of the lifting door, with a force transmission unit which can be coupled to the drive in order to carry out an opening movement which raises the door leaf and a closing movement which lowers the door leaf, wherein at least one compression spring is provided which is arranged in such a way that it supports the opening movement. The invention also relates to a lifting door, in particular an industrial lifting door, which has a door leaf, with a drive, such as a motor, and with a weight compensation device according to the invention.

14 Claims, 6 Drawing Sheets

(56) References Cited

U.S. PATENT DOCUMENTS

| | | | | | |
|---|---|---|---|---|---|
| 2,055,511 | A * | 9/1936 | Twiss | E06B 9/62 | 160/298 |
| 3,007,194 | A * | 11/1961 | Griswold | E05D 13/1269 | 16/193 |
| 5,022,452 | A * | 6/1991 | Burrell | A62C 2/10 | 160/296 |
| 5,172,744 | A * | 12/1992 | Finch | E06B 9/15 | 160/133 |
| 5,488,982 | A * | 2/1996 | Rejc | E06B 3/485 | 160/133 |
| 6,042,158 | A * | 3/2000 | Horn | E05D 13/006 | 16/DIG. 20 |
| 6,276,744 | B1 * | 8/2001 | Huber | B60J 5/14 | 160/181 |
| 6,330,903 | B1 * | 12/2001 | Weinreich | E05D 13/1207 | 160/191 |
| 10,012,015 | B2 * | 7/2018 | Rejc | E06B 9/62 | |
| 2005/0066473 | A1 * | 3/2005 | Noguchi | E05D 13/1253 | 16/193 |
| 2005/0115024 | A1 * | 6/2005 | Bortoluzzi | E05D 13/1253 | 16/198 |
| 2006/0162876 | A1 * | 7/2006 | Kwak | E06B 9/42 | 160/296 |
| 2007/0234643 | A1 * | 10/2007 | Siegal | E05D 13/1284 | 49/360 |
| 2015/0047795 | A1 * | 2/2015 | Bohlen | E06B 9/62 | 160/316 |

FOREIGN PATENT DOCUMENTS

| | | | | |
|---|---|---|---|---|
| GB | 570469 | A * | 7/1945 | E06B 9/13 |
| WO | WO-9839542 | A1 * | 9/1998 | E05D 13/006 |

* cited by examiner

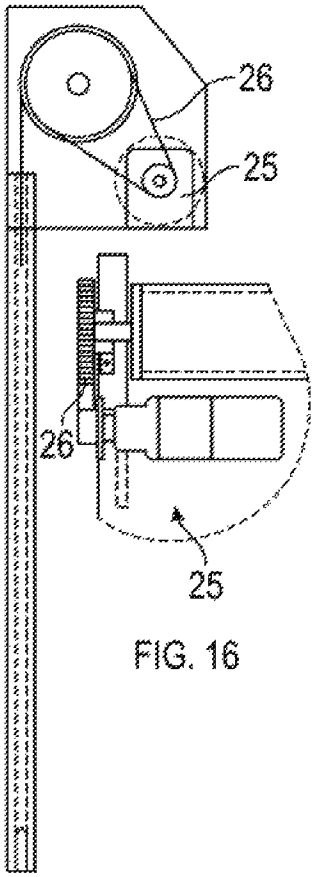
FIG. 16
FIG. 15
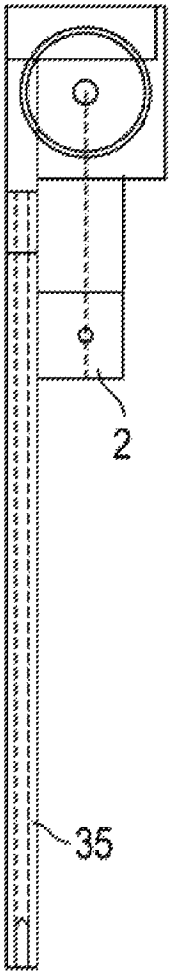
FIG. 14
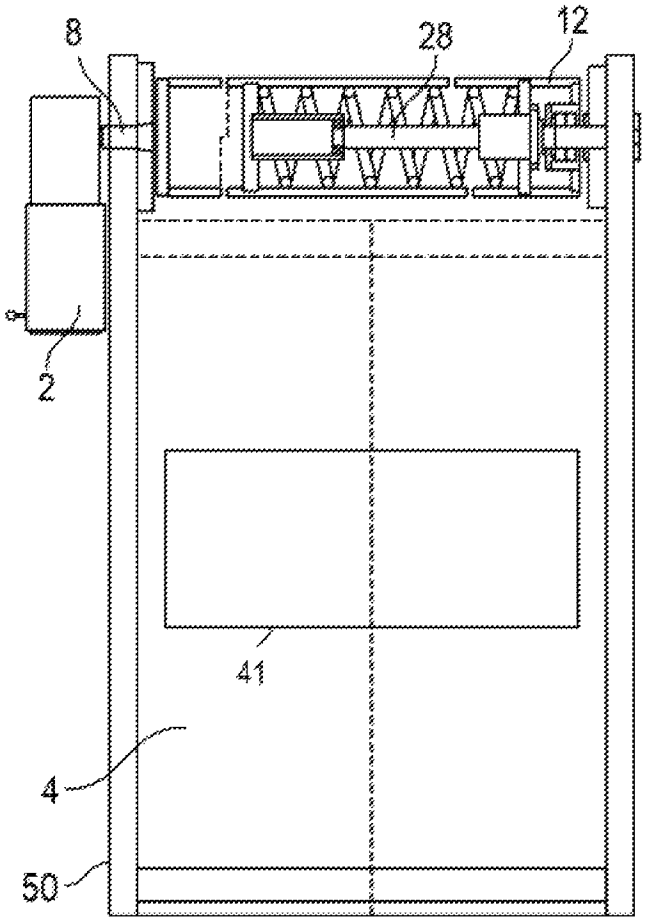
FIG. 12
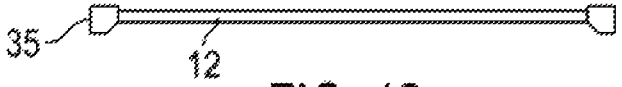
FIG. 13

WEIGHT COMPENSATION DEVICE OF A LIFTING DOOR WITH AT LEAST ONE COMPRESSION SPRING

CROSS-REFERENCE TO RELATED APPLICATIONS

This application is divisional application of and claims priority to U.S. patent application Ser. No. 14/361,394, filed on May 29, 2014, which is a national phase application of and claims priority to PCT Application No. PCT/EP2012/004697, filed Nov. 12, 2012, which claims priority to German Patent Application No. 10 2011 119 895.8, filed Nov. 29, 2011, all of these are incorporated by reference.

BACKGROUND AND SUMMARY

The invention relates to a weight compensation device for a drive of a lifting door for the position-dependent compensation of the weight force of a door leaf of the lifting door, with a force transmission unit which can be coupled to the drive in order to carry out an opening movement which raises the door leaf and a closing movement which lowers the door leaf.

A generic weight compensation device is known from GB 570,469.

From prior art, lifting doors with integrated weight compensation devices are moreover known. For example, DE 40 15 214 A1 discloses a lifting door with a slatted armor with bending slats. The lifting door disclosed therein comprises two guide tracks disposed at the two opposite sides of the door aperture, and a slatted armor with slats placed on hinge straps at such a distance to each other that the hinge pins engage within a space between the adjoining slats. It is furthermore disclosed that this lifting door is configured as an industrial lifting door in the sense of a high-speed lifting door. Such lifting doors are configured as rolling doors which close or open walk-through or drive-through door apertures.

It is known from DE 40 15 214 A1 that tension springs are employed for compensating the weight of the individual slats forming the door leaf. However, a disadvantage of tension springs consists in that they only have a service life of about 200,000 lifts.

Torsion springs employed as an alternative have an even shorter service life of about 30,000 to 40,000 lifts.

The often employed tension springs even have yet another disadvantage, i. e. they require a lot of installation space for heavy doors which must be available in particular at the sides of the door aperture. If a frame of the door is not wide enough to receive adjoining tension springs which provide the required supporting spring force, it is also possible to dispose them one behind the other, but both types affect efficient space utilization in the region of a lifting door.

From prior art, alternative weight compensation devices which are employed, for example, in sectional doors, are also known. For example, DE 102 32 577 A1 discloses a weight compensation device for a sectional door with a rotatably mounted shaft, a rope drum at least at one end of the shaft on which a traction rope connected to the door leaf of the sectional door is connected, and at least one torsion spring configured as a coil spring. The coil spring is retained at one spring end at a stationary receiving part and at the other spring end at a receiving body fixed to the shaft and acts as torsion spring having a particularly short service life.

Even the employment of hydraulic accumulators in industrial lifting doors does not represent an optimal embodiment because constructions employing such hydraulic accumulators are expensive and complex.

It is therefore the object of the present invention to avoid the disadvantages of prior art and to provide an inexpensive, long-life weight compensation device which may be employed in doors where foil-like door leaves or several hinged, preferably rigid segments are lifted, such as spiral doors or doors that employ the drum principle.

This object is achieved according to the invention by a weight compensation device having the features disclosed herein. Such compression springs may bear higher loads over years as compared to tension and especially torsion springs, without any failure occurring already after a relatively short time of use or maintenance works having to be performed at an early stage. In tests performed at certain compression springs, no essential spring deformations showed after one million lifts. The compression spring is arranged in a hollow-cylindrical guide element, the hollow-cylindrical guide element being attached to a mount so as to rotate or, alternatively, in a torque-proof manner, for supporting a rotary motion of the force transmission unit. This permits efficient spring force utilization with a compact design.

A solution according to the invention is therefore not only inexpensive and long living, but also permits the advantage of a particularly simple and efficient construction.

Advantageous embodiments are claimed in the subclaims and will be illustrated more in detail below.

For example, it is advantageous for the compression spring to be coupled to a motion conversion device which employs the force acting in the longitudinal direction to the compression spring for supporting a rotary motion of the force transmission unit that raises or lowers the door leaf. The motion conversion device therefore utilizes the force that can be stored in a compression spring to transfer a supporting torque to the force transmission unit.

It is furthermore advantageous for the compression spring to be arranged essentially horizontally, preferably transversely to the lifting or lowering direction of the door leaf. Thereby, the installation space may be well utilized.

The weight compensation device may be particularly compactly realized when the door leaf surrounds a hollow space in its lifted, wound-up state where the compression spring and/or the motion conversion device are arranged.

To be able to realize spiral doors and drum doors in a particularly easy way, it is advantageous for the guide element to embody a torque-proof hollow cylinder, or for the guide element to embody the drive shaft configured as hollow shaft.

The force of the compression spring may be particularly efficiently used as supporting torque for compensating the weight of the door leaf if the compression spring supports itself at a base part fixed with respect to the guide element and an adjusting element translationally movable relative to the guide element with force transmission.

An advantageous embodiment is characterized in that the drive shaft is in active relation with the adjusting element which is movable in a longitudinal direction of the drive shaft by the compression spring.

A transmission-like embodiment may be achieved if the adjusting element is coupled to the drive shaft so as to transmit torques, preferably in such a way that a movement of the adjusting element along the longitudinal direction enforces torque transmission from the adjusting element to the drive shaft.

In order to avoid any rotation of the adjusting element, for example when the drive shaft is rotating, it is advantageous for the adjusting element to be guided within the hollow shaft so as to be movable in the longitudinal direction, preferably in a groove on the inner side of the hollow shaft which preferably extends essentially in the longitudinal direction. However, it is also possible for the groove to be present at the adjusting element and corresponding diametrically opposed projections to be present on the inner side of the hollow shaft.

If the adjusting element is configured as a spindle nut, one may use a tried and tested conversion element. By this, high forces may be transmitted and components be used that are loadable over a long time.

It is particularly suitable for the spindle nut to be coupled to the drive shaft by threaded engagement. The spring force of the compression spring may be then particularly easily supportively impressed on the drive shaft.

A further advantageous embodiment is characterized in that at least one flexible clutch is embodied in the drive shaft which splits up the latter. Such a flexible clutch, in particular of a claw clutch type, is advantageous for compensating a mechanical overdetermination between lateral bearings which are employed for mounting the drive shaft. It is possible to only use plain bearings on the one side of the claw clutch, whereas on the other side of the claw clutch, a thrust bearing and a plain bearing are combined. It is also possible to use several flexible clutches, such as claw clutches, axially one behind the other and to arrange the corresponding bearings outside these flexible clutches.

The invention also relates to a lifting door, in particular an industrial lifting door, which comprises a door leaf, with a drive, such as a motor, and an inventive weight compensation device as illustrated above. Such a motor may be, for example, an electric motor or a hydraulic or pneumatic motor. Even internal combustion engines are possible power units.

It is then furthermore advantageous for a control window to be provided in the hollow shaft which permits a view to the spindle nut. In this manner, the adjustment of the individual elements with respect to each other becomes controllable.

It is advantageous for the control window to extend along the longitudinal direction and to be preferably oriented horizontally, so that a readjustment or an initial adjustment of the individual elements may be particularly easily controlled. Such a horizontal orientation offers itself especially due to the fact that the hollow shaft, i. e. the drive shaft, is normally arranged such that it extends above the door aperture in the horizontal direction.

If the spindle nut comprises an end plate for which an assembly position is marked in the control window, even untrained personnel may easily perform adjustment and assembly.

It is furthermore advantageous if during the assembly of the lifting door, the coupling between the motor and the spindle nut may be cancelled to bring the spindle nut into a desired assembly position preferably manually and/or using a crank, where coupling may be restored in this position. In this context, a method which uses the control window to bring the end plate, after a decoupling of the corresponding elements, back into the planned position and then restore the coupling is also advantageous.

BRIEF DESCRIPTION OF THE DRAWINGS

The invention will be illustrated more in detail with reference to the drawing in which different embodiments are represented in different views. In the drawings:

FIG. 12 shows a view of a lifting door in which the weight compensation device of FIG. 9 is employed which is shown in a position assumed when the door leaf is in a lifted, opened position, the door leaf itself, however, being shown in a closed position in FIG. 12;

FIG. 13 shows a view onto the door of FIG. 12 from above;

FIG. 14 shows a side view of the door of FIGS. 12 and 13 with a plug-in drive;

FIG. 15 shows a side view of the door of FIGS. 12 to 14, but in the variant of a cylindrical drive with a sprocket belt instead of a plug-in drive;

FIG. 16 shows an enlarged schematic diagram of the cylindrical drive with a sprocket belt of FIG. 15 in a front view;

DETAILED DESCRIPTION

Figure 2:
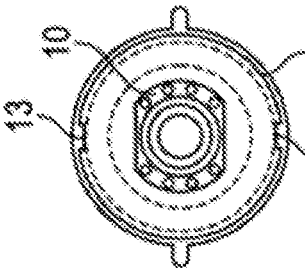
FIG. 2 shows a slightly modified weight compensation device of FIG. 1 in a side view.

The figures are only schematic drawings and only serve the understanding of the invention. Identical elements are provided with identical reference numerals.

Figure 1:
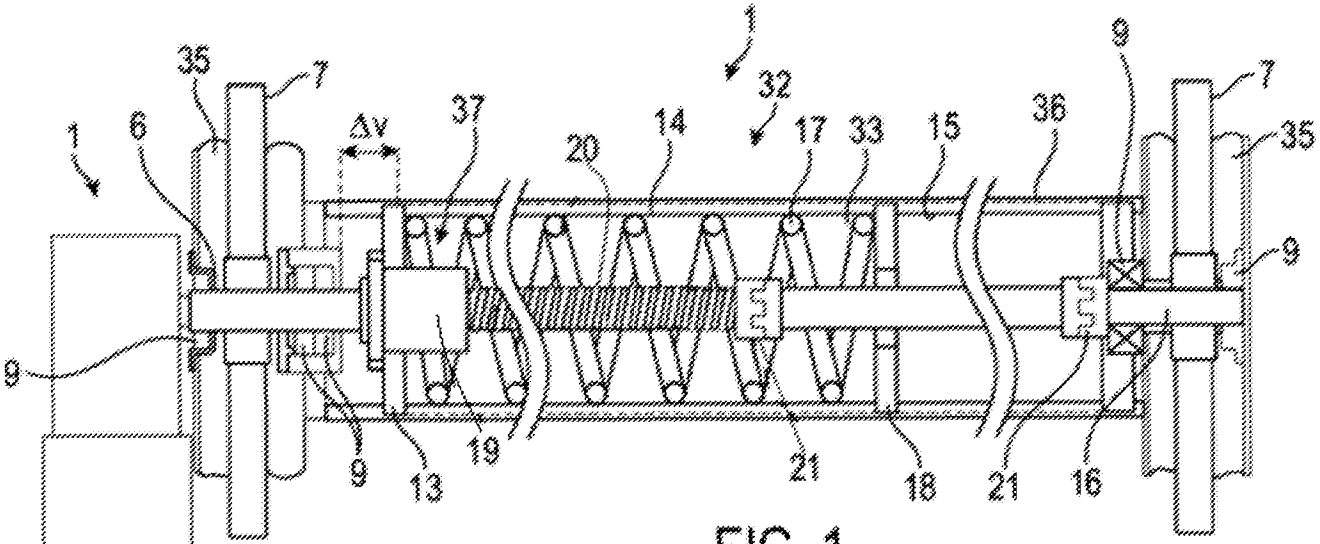
FIG. 1 shows a first weight compensation device according to the invention for a spiral door.
Figure 4:
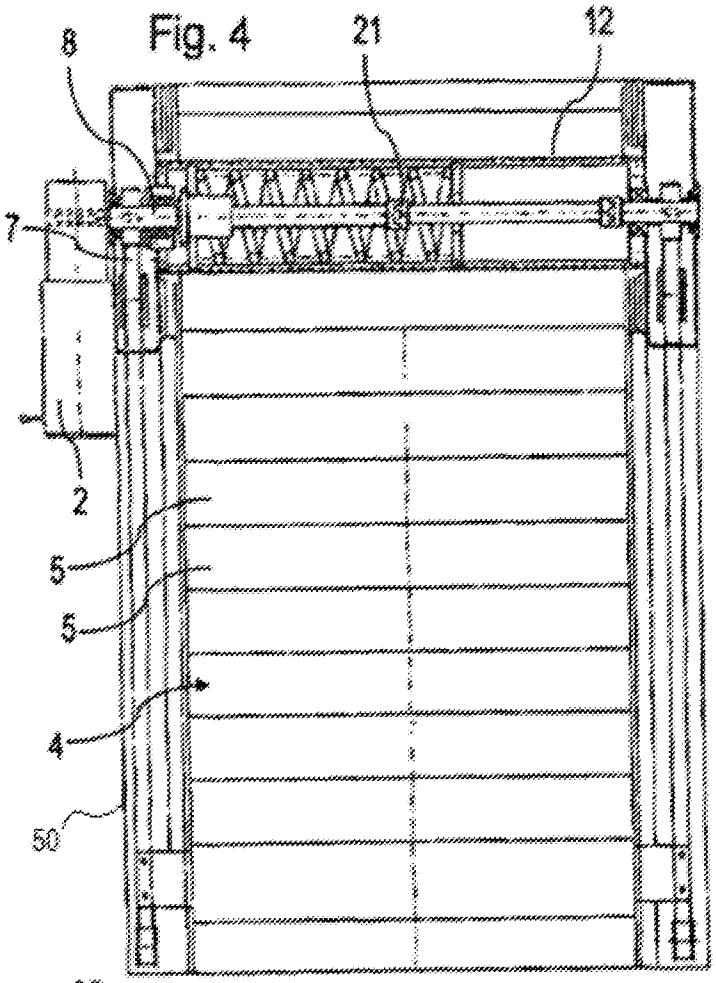
FIG. 4 shows a front view of a spiral lifting door with the weight compensation device of FIGS. 1 to 3 in a partial longitudinal sectional representation where the weight compensation device has assumed a position which is present when the door leaf is raised, while in FIG. 4, the door leaf is shown in a lowered position.
Figure 5:
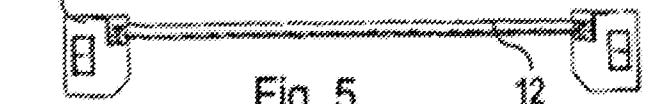
FIG. 5 shows a view of the lifting door of FIG. 4 from above.

FIG. 1 shows a first embodiment of a weight compensation device 1. The weight compensation device 1 is provided for being employed at a drive 2. The drive 2 comprises a motor 3, such as an electric motor. The weight compensation device is provided for compensating the weight of a door leaf 4 depending on the position of the door leaf shown, for example, in FIG. 4, the door leaf being the so-called curtain, assembled from several segments 5 as required.

The weight compensation device comprises a force transmission unit 6. The force transmission unit is designed for activating a raising motion, i.e. an opening motion, and a lowering motion, i. e. a closing motion, of the door leaf 4. The force transmission unit 6 is thus directly or indirectly connected to the door leaf 4, i. e. at least one segment 5 of the door leaf 4.

In the variant for embodying a spiral door represented in FIG. 1, the individual segments 5 are guided at their sides within a spiral or a spiral guide 40 without the segments 5 coming into contact with each other during the winding process. A continuous traction member 7, such as a belt or a chain, functions as drive member for driving the force transmission unit 6.

The force transmission unit 6 is embodied as drive shaft 8. The drive shaft 8 is mounted via four bearings 9, in particular bearings 9 configured as rolling bearings. FIG. 1 shows a position in which the door is opened. On the right side of the weight compensation device 1, a thrust bearing is provided on the inner side of a right-hand continuous traction member 7, whereas a plain bearing is provided on the outer side. On either side of the continuous traction member 7 located on the left side of the weight compensation device 1, several bearings 9 configured as plain bearings are provided.

By means of the drive 2 of the force transmission units 6, i. e. the drive shaft 8, the door leaf 4 is held so that it may be raised and lowered.

A spindle nut 10 is provided on the drive shaft 8 so as to grip around the latter, the spindle nut comprising an end plate 11. The end plate 11 is located in a stationary hollow shaft 12. At least one projection 13 of the end plate 11 is positively locked with a groove 14 on the inner side 15 of the hollow shaft 12. The groove 14 is a longitudinal groove, i. e. a groove extending in parallel to the longitudinal axis 16 of the drive shaft 8.

A preferably metallic compression spring 17 is provided concentrically to the longitudinal axis 16. The compression spring 17 is configured as flat spiral spring extending along the longitudinal axis of the hollow shaft 12. The compression spring 17 is a component which is in a solid aggregation state under normal pressure and temperature conditions that normally prevail in the surrounding area. It is a metallic component which acts in an elastically restituting manner. Being relieved, it returns to its original shape. Here, it is embodied as a wound spring.

The compression spring 17 is prestressed by the value $\Delta_v$ between the end plate 11 and a base part 18. The base part 18 is in this embodiment connected to the hollow shaft 12 in a torque-proof and axially fixed manner. For the compression of the compression spring 17, it is relevant that it is disposed between the base part 18 and the adjusting element 37, such that it may be translationally compressed.

It is also possible for the base part 18 to be replaced by an embodiment similar to an adjusting element such that this component similar to an adjusting element is present on the same spindle as the spindle nut 10. The two parts are then arranged on threads running in opposite directions.

Projecting from the end plate 11 in the direction of the base part 18, a bushing 19 is embodied which may be integrally formed with the end plate 11 or may be connected to it with a form-fit, a frictional connection and/or by a material bond. On the inner side of the bushing 19, a thread is formed which is in threaded engagement with a threaded section 20 of the drive shaft 8.

The drive shaft 8 is split into three parts, where in the transitional region between the individual parts of the drive shaft 8, one flexible clutch 21, in particular of a flexible claw clutch type, is provided each.

In operation of the spiral door, the hollow shaft 12 is standing still, whereas the drive shaft 8 is rotatable. Depending on the compression state of the spring 17, more or less torque is applied to the drive shaft 8 by means of the spindle nut 10 by the longitudinal displacement of the end plate 11 via the threaded engagement of the bushing 19.

In FIG. 2, two diametrically opposed projections 13 of the spindle nut 10 can be seen which are engaged in two longitudinal grooves, i. e. grooves 14 which extend in the longitudinal direction, i. e. in parallel to the longitudinal axis 16. It is also possible for the groove 14 to be provided in the hollow shaft 12 of an external tube-type or the spindle nut 10.

Figure 3:
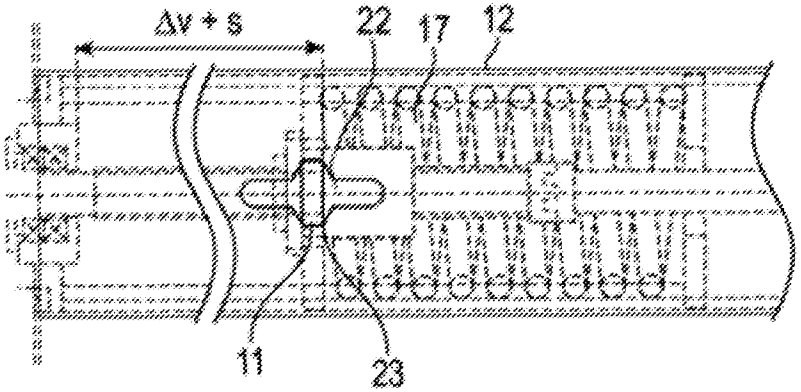
FIG. 3 shows a weight compensation device of FIG. 1 in a longitudinal sectional view as in FIG. 1, however in a position in which, different from FIG. 1, the door aperture is closed.

FIG. 3 shows a detail of the weight compensation device 1 in the position where the door is closed. The interior of the hollow shaft 12 is represented in a dot-dash line, where now the end plate 11 is spaced apart from a left end of the hollow shaft or an extension of the hollow shaft by a distance $\Delta_v$+s. $\Delta_v$ designates the path caused by the spring tension, and s designates the spring trajectory caused by the adjustment.

A control window 22, i. e. an opening in the wall of the hollow shaft 12, is formed which permits a view to the end plate 11. In the central region of the control window 22, a widening 23 is present which represents a mark for an optimal assembly position.

Figure 6:
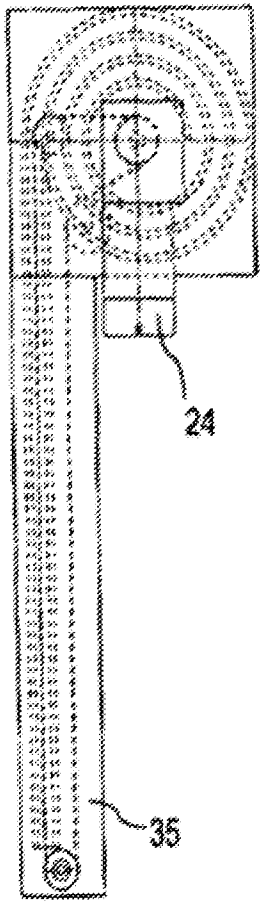
FIG. 6 shows a side view of the spiral lifting door of FIGS. 4 and 5 with a plug-in drive.
Figure 7:
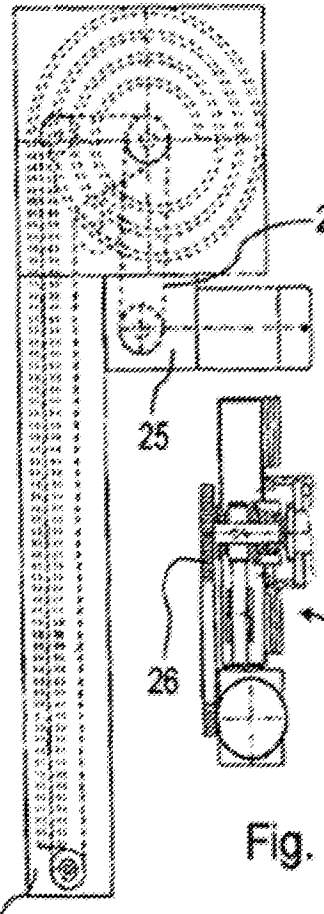
FIG. 7 shows the variant of a lifting door of FIGS. 4, 5 and 6, however with a straight bevel gear drive and a sprocket belt.

FIGS. 4 to 7 show the complete lifting door in three views, where in FIG. 6, a drive 2 configured as plug-in drive 24 is employed, and in the variant as it is shown in FIG. 7, instead of the plug-in drive 24, a straight bevel gear drive 25 with a sprocket belt 26 is employed.

A frame width is only determined by a door leaf guide 39 and possibly also by the continuous traction member 7. In the variant shown in FIGS. 1 to 8, the frame width is determined by both components, whereas in the embodiment of FIGS. 9 and 16, the width is exclusively determined by the door leaf guide 39, because no continuous traction member 7 is present, and the drive is realized via the hollow shaft 12.

Figure 8:
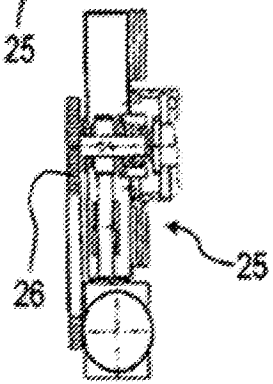
FIG. 8 shows an enlarged sectional representation of the straight bevel gear drive of FIG. 7.

In FIG. 8, a further cross-section of FIG. 7 is shown by which a so-called "longitudinal arrangement" may be realized. The motor may be arranged to be aligned with the frame, permitting a particularly efficient saving in space. In particular also by the arrangement of the compression spring 17 remote from the frame, the frames may be kept relatively narrow. These arrangements of the motor and the compression spring may be generally realized in all shown embodiments of the invention.

Different to prior art, the spring configured as compression spring is not arranged in the vertical direction but in the horizontal direction within the hollow shaft 12 so as to surround the drive shaft 8.

The compression spring 17 is located in a hollow space 33. The hollow space 33 is defined by the wound-up door leaf 4. The door leaf 4 is guided in the spiral guide 40 and surrounds the hollow space 33 in its wound-up state.

A motion conversion device 32 is coupled to the compression spring 17 and comprises at least the base part 18, the pressure element 34 which is configured as hollow cylinder 36 and has in particular assumed the shape of the hollow shaft 12 and comprises the groove 14 extending in the longitudinal direction on its inner side, and an adjusting element 37 which is configured as spindle nut 10 with a bushing 19 and an end plate 11.

The motion conversion device 32 converts the rotary drive energy into a translational kinetic energy.

The compression spring 17 is arranged horizontally between two vertical frames 50 of a mount 35.

Figure 9:
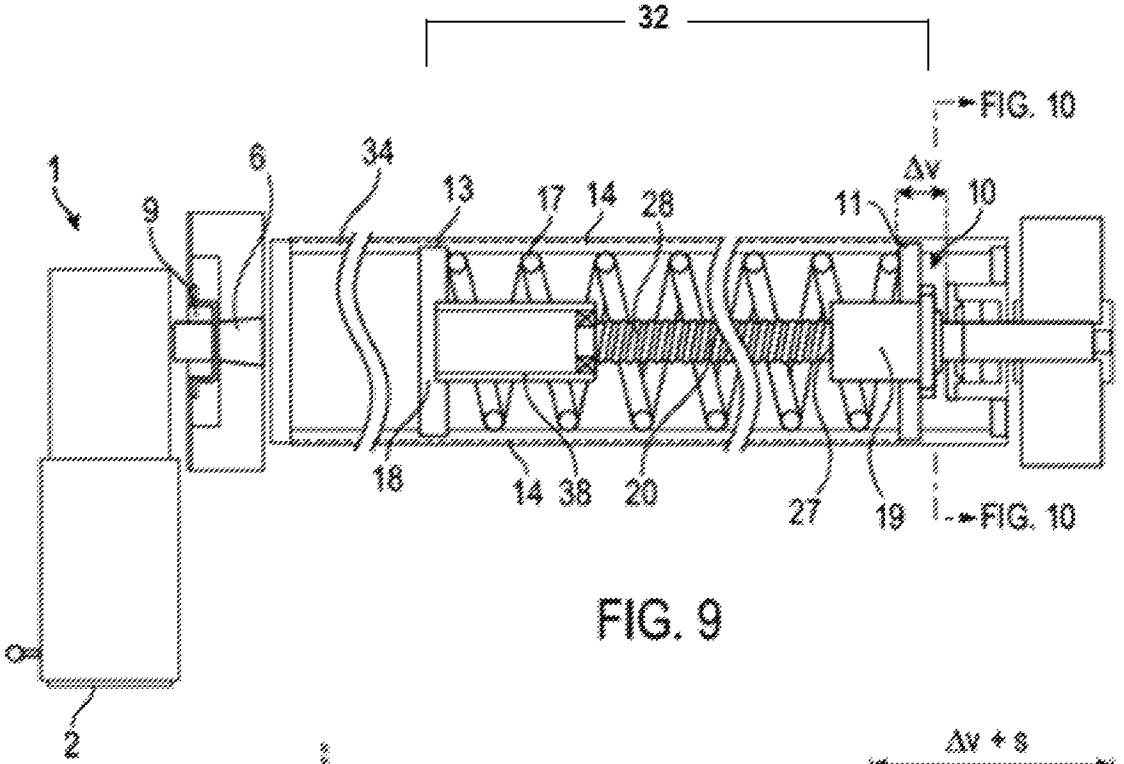
FIG. 9 shows a weight compensation device for a lifting door which realizes a drum winding in a partial longitudinal sectional representation, the weight compensation device being shown in a position where the door aperture is unclosed, i. e. the door is held open.
Figure 11:
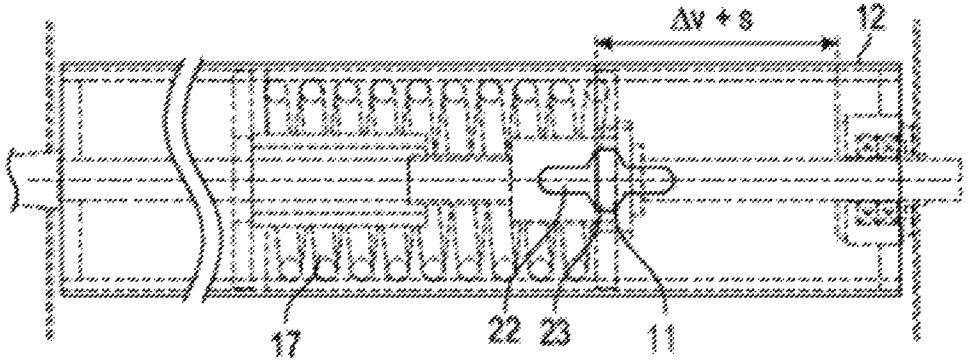
FIG. 11 shows a partial longitudinal sectional view of the weight compensation device of FIG. 9, but in a closed position, i. e. in a position where the door aperture is closed by the door.

FIG. 9 shows a second embodiment of a weight compensation device 1 which is also represented in an opened door position. The drive shaft 8 is connected to the hollow shaft 12 in a torque-proof manner, so that the hollow shaft 12 may be rotated in the sense of a drum, and when the door is being opened, the individual segments 5 of the door leaf 4 are wound onto the hollow shaft 12 like on a drum. The door leaf 4 may also have a foil-like character and then be just as easily wound up. The spindle nut 10 also comprises an end plate 11 and a bushing 19, as in the first embodiment. The bushing 19 has a threaded engagement section which is provided with reference numeral 27. This threaded engagement section 27 engages a threaded section 20 of a stationary shaft 28. The shaft 28 is firmly connected to the base part 18.

The end plate 11 comprises projections 13 which are guided in a groove 14 formed on the inner side 15 of the hollow shaft 12 in the longitudinal direction. One projection 13 each is guided in one groove 14 each. The base part 18 also comprises such projections 13 which are also guided in one groove 14 each. However, it is also possible for the compression spring 17 configured as base part 18 to be connected to the hollow shaft 12 in a torque-proof and/or translationally fixed manner by a form-fit, a frictional connection, and/or a material bond.

In the illustrated second embodiment, the drive shaft 8 is connected to the hollow shaft 12 in a torque-proof manner. In this embodiment, as illustrated in FIG. 10, one does not rely on only two opposed projections 13 at the end plate 11, but four projections 13, which have the same angular distance with respect to each other.

Figure 10:
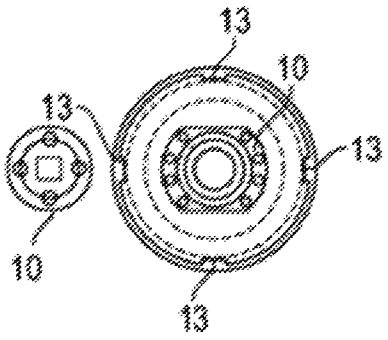
FIG. 10 shows a view from the side onto the slightly modified weight compensation device of FIG. 9.

As can also be seen in FIG. 10, the projections or grooves may be either located at the one component or at the other component as long as a longitudinal guidance is ensured. It is principally also conceivable to interchange the positions of the longitudinal guiding elements and screw elements.

In all embodiments, the compression spring may optionally support itself radially in the hollow-cylindrical guide element 34, preventing a buckling of the spring.

The base part of FIG. 9 also comprises an extension section 38 which permits to shorten the stationary shaft 28 with the threaded section 20.

As was already stated with respect to the embodiment according to FIGS. 1 to 8, the second embodiment of FIGS. 9 to 16, too, comprises a control window 22, where here, however, a plate-like section of the base part 18 can be seen. The base part 18 may be interchanged with the spindle nut 10, if desired.

In FIGS. 13 and 15, the door leaf 4 is, for illustration reasons, shown with a control window 41 and a termination shield (not shown) in a position closing the passage, although the compression spring 17 is in a relieved position.

Views corresponding to the views shown in FIGS. 4 to 8 with respect to the second embodiment of the weight compensation device 1 are shown in FIGS. 12 to 16.

Figure 17:
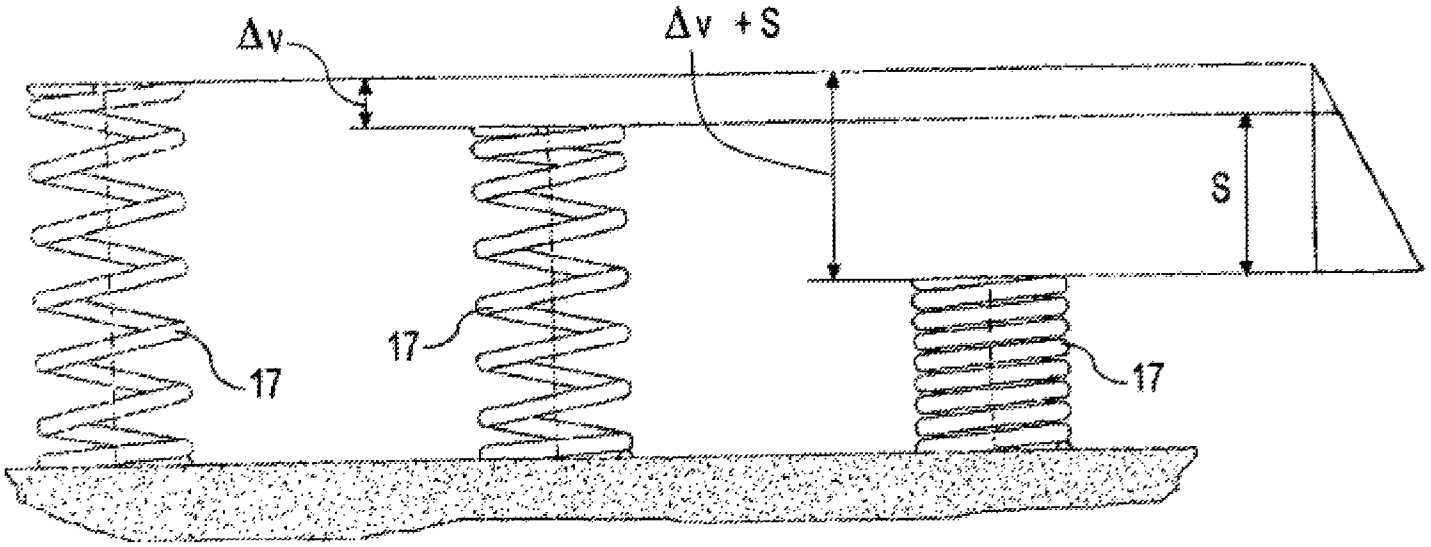
FIG. 17 shows a schematic diagram of the different spring positions of the compression spring.

In FIG. 17, three positions of the compression spring 17 are shown, which are a non-stressed compression spring 17 leftmost, a prestressed spring in the middle, and a completely stressed compression spring 17 rightmost. In operation, the compression spring 17 is in its maximal positions in a state in accordance with the central and right positions.

Figure 18:
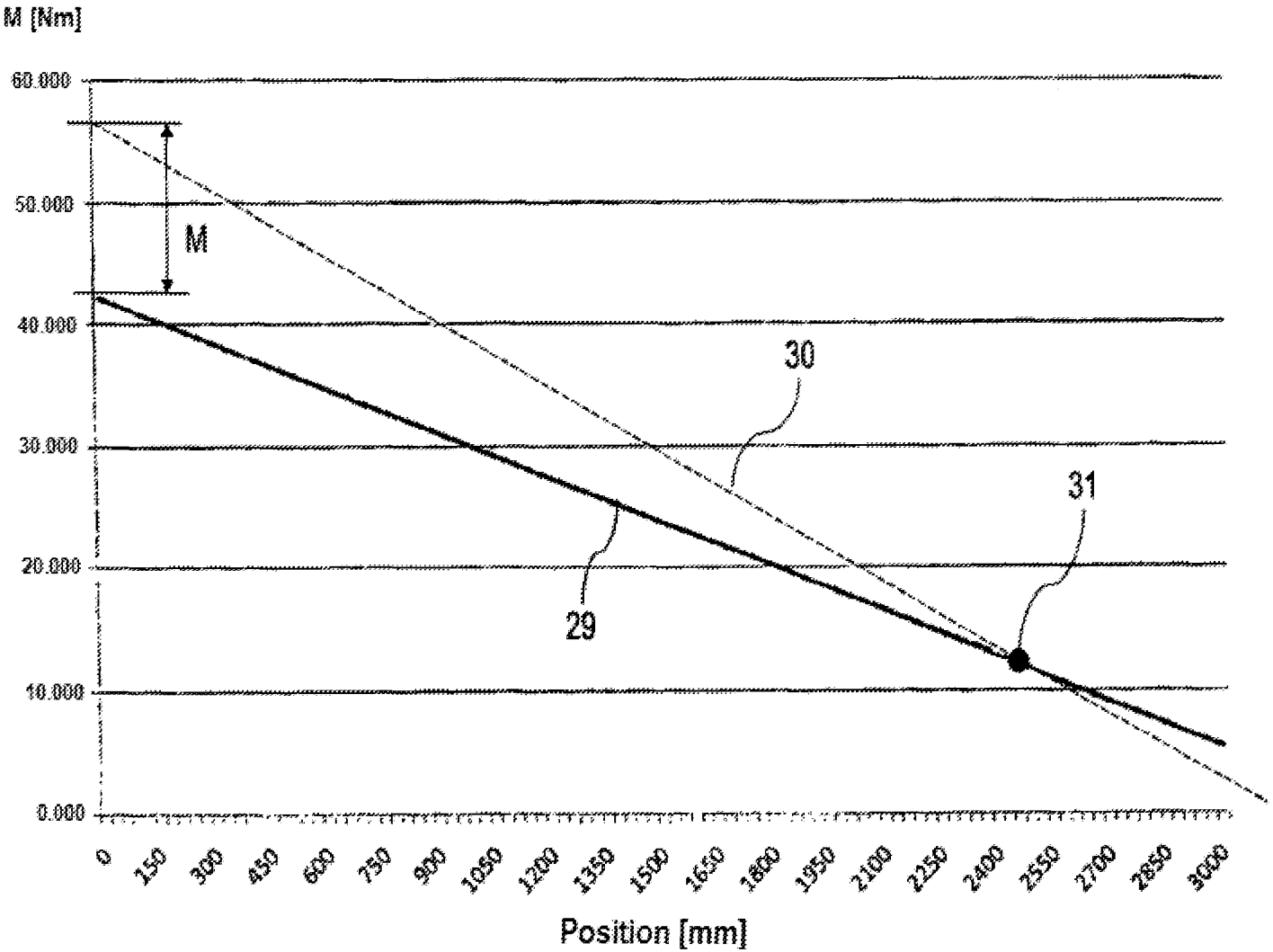
FIG. 18 shows a torque diagram for the compression spring with a fixed motor torque.

FIG. 18 shows a spring tension relative to a present motor torque M, where the continuous first line 29 represents the torque $T_t$ caused by the weight of the door leaf 4 in response to its position, and the dashed second line 30 represents the torque $T_f$ caused by the spring. The torque moment is designated with M and is the distance between lines 29 and 30. From the maximum opening position, a compensation point 31 is achieved by the intersection of both lines 29 and 30, so that a deceleration of the door leaf is achieved just before the maximum opening position.

In the embodiment visualized in FIGS. 9 to 16, too, the compression spring 17 is located in a hollow space within the wound-up door leaf 4.

Embodiments which are designed corresponding to the following computations proved to be particularly advantageous:

1. Door Leaf-Related Torque:
Door leaf weight: $G_t$=115 kg
Crown gear diameter: $d_o$=75 mm
g: Gravitational acceleration 9.81 m/s$^2$ $$T_t = F_t \cdot a = G_t \cdot g \cdot \frac{d_o}{2} = 115 \cdot 9,81 \cdot \frac{75}{2} = 42,3\ Nm$$

2. Spring-Related Torque:
Spring force $F_f$=9000 N
Spindle diameter 40 mm, pitch $P_h$=40 mm
Efficiency with linear rotation $\eta_2$=0.98

$$T_f = \frac{F_f \cdot Ph \cdot \eta_2}{2\pi} = \frac{9000 \cdot 40 \cdot 0,98}{2\pi} = 56,2\ Nm$$

3. Required Motor/Driving Torque $$T_m = T_f - T_t = 56.2 - 42.3 = 13.9\ \text{Nm}$$

What is claimed:

1. A weight compensation device for a drive of a lifting door for position-dependent compensation of a weight force of a door leaf of the lifting door comprising a drive shaft, which is configured to be coupled to the drive in order to carry out an opening movement which raises the door leaf and a closing movement which lowers the door leaf, wherein at least one compression spring is provided and arranged such that the compression spring supports the opening movement, and the compression spring is arranged in a hollow-cylindrical guide element, characterized in that the hollow-cylindrical guide element is rotatably attached to a mount for supporting a rotary motion of the drive shaft, and wherein the compression spring is supported on a rotatable base part and on an adjusting element, in a force transmitting manner, wherein the rotatable base part is fixed with respect to the hollow-cylindrical guide element such that the base part and the hollow-cylindrical guide element rotate together, and the adjusting element is translationally movable relative to the hollow-cylindrical guide element.

2. The weight compensation device according to claim 1, characterized in that the compression spring is coupled to a motion conversion device which employs a force of the compression spring acting in a longitudinal direction for supporting the rotary motion of the drive shaft raising or lowering the door leaf.

3. The weight compensation device according to claim 2, characterized in that the door leaf wound-up in a raised state surrounds a hollow space in which the motion conversion device is arranged.

4. The weight compensation device according to claim 1, characterized in that the compression spring is arranged horizontally to a raising or lowering direction of the door leaf.

5. The weight compensation device according to claim 1, wherein the compression spring is located in a hollow space when the door leaf is raised.

6. The weight compensation device according to claim 1, characterized in that the drive shaft is in active relation with the adjusting element which is movable by the compression spring in a longitudinal direction of the drive shaft.

7. The weight compensation device according to claim 1, characterized in that the adjusting element is coupled to the drive shaft so as to transmit torques, such that a movement of the adjusting element along a longitudinal direction enforces torque transmission from the adjusting element to the drive shaft.

8. The weight compensation device according to claim 1, characterized in that the adjusting element is guided within the hollow-cylindrical guide element to be shifted in a longitudinal direction, in a groove on an inner side of the hollow-cylindrical guide element which extends essentially in the longitudinal direction.

9. The weight compensation device according to claim 1, characterized in that the adjusting element is formed as a spindle nut.

10. The weight compensation device according to claim 1, characterized in that the compression spring is arranged remote from frames of the mount.

11. The lifting door comprising the door leaf with the drive and the weight compensation device according to claim 1.

12. The lifting door according to claim 11, wherein the drive is a plug-in drive.

13. The weight compensation device according to claim 1, characterized in that the door leaf wound-up in a raised state surrounds a hollow space in which the compression spring and a motion conversion device are arranged.

14. The weight compensation device according to claim 1, characterized in that the compression spring is arranged transversely to a raising or lowering direction of the door leaf.

* * * * *